US010626739B2

(12) United States Patent
Iwakiri

(10) Patent No.: US 10,626,739 B2
(45) Date of Patent: Apr. 21, 2020

(54) ROTARY MACHINE

(71) Applicant: MITSUBISHI HEAVY INDUSTRIES, LTD., Tokyo (JP)

(72) Inventor: Kenichiro Iwakiri, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 239 days.

(21) Appl. No.: 15/552,005

(22) PCT Filed: Oct. 27, 2015

(86) PCT No.: PCT/JP2015/080170
§ 371 (c)(1),
(2) Date: Aug. 18, 2017

(87) PCT Pub. No.: WO2017/072844
PCT Pub. Date: May 4, 2017

(65) Prior Publication Data

US 2018/0073376 A1 Mar. 15, 2018

(51) Int. Cl.
*F01D 5/20* (2006.01)
*F01D 7/00* (2006.01)
(Continued)

(52) U.S. Cl.
CPC ..... *F01D 7/00* (2013.01); *F01D 5/02* (2013.01); *F01D 5/20* (2013.01); *F01D 11/14* (2013.01);
(Continued)

(58) Field of Classification Search
CPC ..... F01D 17/162; F01D 5/143; F01D 17/167; F01D 11/14; F01D 7/00; F01D 5/20;
(Continued)

(56) References Cited

U.S. PATENT DOCUMENTS 835,836 A * 11/1906 Schulz ..... F16J 15/4472 277/419
2,651,496 A * 9/1953 Buckland ..... F01D 9/065 415/135
(Continued)

FOREIGN PATENT DOCUMENTS

JP 30-818 2/1955
JP 53-162407 S 5/1976
(Continued)

OTHER PUBLICATIONS

JP-026904A—Machine Translation (Year: 1993).*
(Continued)

*Primary Examiner* — Woody A Lee, Jr.
*Assistant Examiner* — Brian Christopher Delrue
(74) *Attorney, Agent, or Firm* — Birch, Stewart, Kolasch & Birch, LLP

(57) ABSTRACT

A rotary machine satisfies at least one of Dr1<Dh1≤Dr2 or Dc1≥Dt1>Dc2. Dr1, Dh1, Dr2, Dc1, Dt1, and Dc2 are distances from a rotational center axis of a hub to an upstream end of a first blade-facing surface facing a hub-side end surface of a variable blade, an upstream end of the hub-side end surface when the blade angle is maximum, a downstream end of a first outer peripheral surface adjacent to an upstream side of the blade-facing surface, an upstream end of a second blade-facing surface facing a tip-side end surface of the variable blade, an upstream end of the tip-side end surface when the blade angle is minimum, and a downstream end of a first inner peripheral surface adjacent to an upstream side of the second blade-facing surface, respectively.

8 Claims, 9 Drawing Sheets

WHEN BLADE ANGLE IS MAXIMUM

(51) Int. Cl.

| | |
|---|---|
| ***F04D 29/16*** | (2006.01) |
| ***F04D 29/32*** | (2006.01) |
| ***F01D 17/16*** | (2006.01) |
| ***F01D 11/14*** | (2006.01) |
| ***F04D 29/56*** | (2006.01) |
| ***F01D 5/02*** | (2006.01) |
| *F01D 25/24* | (2006.01) |

(52) U.S. Cl.
CPC ..... *F01D 17/162* (2013.01); *F04D 29/164* (2013.01); *F04D 29/323* (2013.01); *F04D 29/563* (2013.01); *F01D 17/16* (2013.01); *F01D 25/24* (2013.01); *F05D 2250/241* (2013.01); *F05D 2250/90* (2013.01); *F05D 2260/74* (2013.01)

(58) Field of Classification Search
CPC ..... F05D 2250/241; F05D 2250/711; F05D 2250/712; Y02T 50/673
USPC ..... 415/160
See application file for complete search history.

(56) References Cited

U.S. PATENT DOCUMENTS 2,963,268 A * 12/1960 Paulson ..... F01D 5/225 277/414
3,701,536 A * 10/1972 Matthews ..... F16J 15/445 277/415
3,885,886 A * 5/1975 Richter ..... F01D 5/187 415/116
3,990,810 A * 11/1976 Amos ..... F01D 17/162 415/161
3,992,127 A * 11/1976 Booher, Jr. ..... F01D 9/042 415/136
4,013,377 A * 3/1977 Amos ..... F01D 17/162 415/161
4,150,915 A * 4/1979 Karstensen ..... F01D 17/162 251/249.5
4,278,398 A * 7/1981 Hull ..... F01D 17/162 415/160
4,732,538 A * 3/1988 Wollenweber ..... F01D 5/084 416/129
4,738,586 A * 4/1988 Harter ..... F01D 5/20 415/173.5
4,861,228 A * 8/1989 Todman ..... F01D 17/162 415/115
4,884,820 A * 12/1989 Jackson ..... C21D 1/09 277/415
5,297,931 A * 3/1994 Yapp ..... F01D 5/141 415/208.1
5,489,186 A * 2/1996 Yapp ..... F01D 5/141 415/208.3
6,350,102 B1 * 2/2002 Bailey ..... F01D 5/20 415/173.5
6,602,049 B2 * 8/2003 Caubet ..... F01D 5/143 415/160
6,709,231 B2 * 3/2004 Schipani ..... F01D 5/143 415/160
8,360,712 B2 * 1/2013 Deo ..... F01D 11/02 415/1
8,439,634 B1 * 5/2013 Liang ..... F01D 11/10 415/115
8,668,445 B2 * 3/2014 Crespo ..... F01D 9/04 415/160
9,533,485 B2 * 1/2017 Marshall ..... F01D 17/162
9,638,212 B2 * 5/2017 Marshall ..... F04D 29/544
9,708,914 B2 * 7/2017 Fulayter ..... F01D 17/162
2002/0061249 A1 * 5/2002 Caubet ..... F01D 5/143 415/160
2004/0240990 A1 * 12/2004 Rockley ..... F01D 17/162 415/148
2005/0091849 A1 * 5/2005 Brooks ..... F01D 17/162 29/889.21
2005/0220610 A1 * 10/2005 Ghasripoor ..... F01D 5/225 415/173.3
2007/0289286 A1 * 12/2007 Bauer ..... F01D 11/14 60/204
2011/0070074 A1 * 3/2011 Schabowski ..... F01D 11/08 415/174.5
2011/0299977 A1 * 12/2011 Memmer ..... F01D 11/122 415/173.4
2012/0248704 A1 * 10/2012 Fennell ..... F01D 11/025 277/360
2013/0084168 A1 * 4/2013 Babu ..... F01D 5/225 415/173.5
2013/0236298 A1 * 9/2013 Chouhan ..... F01D 11/02 415/173.5
2013/0312249 A1 * 11/2013 Buchal ..... F01D 11/14 29/593
2014/0255188 A1 * 9/2014 Fulayter ..... F01D 17/162 416/1
2015/0003972 A1 * 1/2015 Lim ..... F02C 7/28 415/173.2
2015/0037145 A1 * 2/2015 Casavant ..... F01D 11/16 415/173.3
2016/0010560 A1 * 1/2016 Dierksmeier ..... F01D 5/085 60/772

FOREIGN PATENT DOCUMENTS

| | | | |
|---|---|---|---|
| JP | 57-117799 | U | 1/1981 |
| JP | 58-183898 | A | 10/1983 |
| JP | 59-73600 | S | 5/1984 |
| JP | 3-13498 | U | 2/1991 |
| JP | 7-26904 | A | 1/1995 |
| JP | 2007-321721 | A | 12/2007 |

OTHER PUBLICATIONS

Office Action dated Dec. 26, 2018 in corresponding Chinese Application No. 201580081804.1.
English Translation of Written Opinion of the International Searching Authority of PCT/JP2015/080170 dated Jan. 26, 2016.
International Search Report of PCT/JP2015/080170 dated Jan. 26, 2016.
Office Action dated May 26, 2017 issued in corresponding JP Application No. 2014-167695 with Translation.

* cited by examiner

WHEN BLADE ANGLE IS MINIMUM

WHEN BLADE ANGLE IS MAXIMUM

WHEN BLADE ANGLE IS MINIMUM

WHEN BLADE ANGLE IS MAXIMUM

WHEN BLADE ANGLE IS MINIMUM

WHEN BLADE ANGLE IS MAXIMUM

ROTARY MACHINE

TECHNICAL FIELD

The present disclosure relates to a rotary machine.

BACKGROUND ART

In a rotary machine such as a compressor and a turbine, at least one of a stationary vane or a rotor blade may be configured as a variable blade that is revolvable about a pivot axis along the radial direction of a hub, to adjust the attack angle with respect to flow.

In a rotary machine provided with such a variable blade, if the variable blade is configured such that the hub-side end surface of the variable blade does not interfere with the blade-facing surface of the hub in the rotation range of the variable blade, clearance between the hub-side end surface of the variable blade and the blade-facing surface of the hub is likely to increase when the variable blade is revolved toward the close side (in a direction that the angle between the chord line of the variable blade and the axial direction of the hub increases). Furthermore, if the rotary machine is configured such that the tip-side end surface of the variable blade does not interfere with the blade-facing surface of the casing in the rotation range of the variable blade, clearance between the tip-side end surface of the variable blade and the blade-facing surface of the casing is likely to increase when the variable blade is revolved toward the open side (in a direction that the angle between the chord line of the variable blade and the axial direction of the hub decreases). As described above, if the clearance between the hub-side end surface of the variable blade and the blade-facing surface of the hub or the clearance between the tip-side end surface of the variable blade and the blade-facing surface of the casing increases, loss due to a leakage flow that passes through the clearance (hereinafter, referred to as clearance loss) increases, and the efficiency of the rotary machine may decrease.

Patent Document 1 discloses a rotary machine with a variable blade including a spherically-shaped hub-side end surface recessed outward in the radial direction of the hub and a hub including a blade-facing surface which has a spherically-shaped spherical region protruding outward in the radial direction of the hub, so that the clearance between the hub-side end surface of the variable blade and the blade-facing surface of the hub does not increase at rotation of the variable blade toward the closing side.

Patent Document 2 discloses a configuration in which a trench is formed on the inner surface of the casing that faces the tip-side end surface of the blade and the tip-side end surface of the blade protrudes into the groove, to suppress a decrease in the efficiency of the rotary machine device due to a leakage flow that passes through the clearance between the tip-side end surface of the blade and the blade-facing surface of the casing.

CITATION LIST

Patent Literature

Patent Document 1: JPH3-13498U (Utility Model)
Patent Document 2: JPH7-26904A

SUMMARY

Problems to be Solved

If the blade-facing surface of the hub has a spherically-shaped spherical region protruding outward in the radial direction of the hub like the rotary machine described in Patent Document 1, the spherical region protruding into a flow path obstructs the smooth flow of fluid in the flow path unless some measure is provided. As a result, an outward flow in the radial direction of the hub (secondary flow) is created, or separation or the like occurs downstream of the spherical region, which may lead to deterioration of the performance of the rotary machine.

Further, the blade of the rotary machine described in Patent Document 2 is supposed to be a fixed blade not having a pivot axis along the radial direction and not a variable blade. Thus, Patent Document 2 does not mention how to suppress an increase in the above described clearance loss at rotation of the variable blade.

In view of the above, an object of at least one embodiment of the present invention is to, in a rotary machine provided with a variable blade configured to be revolvable about a pivot axis along the radial direction of a hub, suppress an increase in clearance loss that accompanies rotation of a variable blade.

Solution to the Problems (1) A rotary machine according to at least one embodiment of the present invention comprises: a hub configured to be rotatable about a rotational center axis; a casing configured to cover the hub and forming a fluid flow passage between the casing and the hub; and a variable blade disposed in the fluid flow passage and configured to be revolvable about a pivot axis along a radial direction of the hub. The hub includes: a blade-facing hub portion including a first blade-facing surface facing a hub-side end surface of the variable blade; and an upstream hub portion disposed upstream of the blade-facing hub portion in an axial direction of the hub and having a first outer peripheral surface being adjacent to the first blade-facing surface in the axial direction. The casing includes: a blade-facing casing portion including a second blade-facing surface which faces a tip-side end surface of the variable blade; and an upstream casing portion disposed upstream of the blade-facing casing portion in the axial direction and having a first inner peripheral surface being adjacent to the second blade-facing surface in the axial direction. At least one of following condition (a) or (b) is satisfied:

$$Dr1<Dh1\leq Dr2 \quad (a)$$

$$Dc1\geq Dt1>Dc2 \quad (b)$$

where Dr1 is a distance between an upstream end of the first blade-facing surface and the rotational center axis of the hub (rotational axis direction of the rotary machine), Dh1 is a distance between an upstream end of a hub-side end surface of the variable blade and the rotational center axis of the hub when an angle formed between the axial direction of the hub and a chord line of the variable blade is maximum, Dr2 is a distance between a downstream end of the first outer peripheral surface and the rotational center axis of the hub, Dc1 is a distance between an upstream end of the second blade-facing surface and the rotational center axis of the hub, Dt1 is a distance between an upstream end of the tip-side end surface of the variable blade and the rotational center axis of the hub when the angle formed between the axial direction of the hub and the chord line of the variable blade is minimum, and Dc2 is a distance between a downstream end of the first inner peripheral surface and the rotational center axis of the hub.

If the variable blade is configured such that the hub-side end surface of the variable blade does not interfere with the blade-facing surface of the hub in the rotation range of the variable blade, clearance between the hub-side end surface of the variable blade and the blade-facing surface of the hub (hereinafter, referred to as the hub-side clearance) is maximum when the angle formed between the chord line of the variable blade and the axial direction of the hub (hereinafter, referred to as blade angle) is maximum. Furthermore, if the rotary machine is configured such that the tip-side end surface of the variable blade does not interfere with the blade-facing surface of the casing in the rotation range of the variable blade, clearance between the tip-side end surface of the variable blade and the blade-facing surface of the casing (hereinafter, referred to as the tip-side clearance) is maximum when the blade angle is minimum. Herein, the blade angle being "maximum" and "minimum" refers to "maximum" and "minimum" in the rotation range used during operation of the rotary machine.

Thus, like the rotary machine described in the above (1), if at least one of the above condition (a) or (b) is satisfied, at least one of the hub-side clearance or the tip-side clearance is retracted from the mainstream of the fluid flow passage at the upstream end of the variable blade at any blade angle. Thus, it is possible to reduce clearance loss due to a leakage flow that passes through at least one of the hub-side clearance or the tip-side clearance.

Furthermore, with the above rotary machine (1), if at least one of $Dr1<Dr2$ (part of condition (a)) or $Dc1>Dc2$ (part of condition (b)) is satisfied, a step is formed between the first outer peripheral surface and the first blade-facing surface or between the first inner peripheral surface and the second blade-facing surface. This step generates a recirculation flow in at least one of the vicinity of the blade-facing surface of the hub or the vicinity of the blade-facing surface of the casing. This recirculation flow increases the virtual flow rate, and thus it is possible to suppress separation on the hub or the casing.

(2) In some embodiments, in the rotary machine described in the above (1), at least the above condition (a) is satisfied, and the first blade-facing surface is inclined so as to be away from the rotational center axis of the hub toward downstream.

Herein, whether separation occurs tends to depend on the flow rate in the vicinity of the leading edge of the blade. If the flow rate in the vicinity of the leading edge of the blade is set to be high, separation can be suppressed easily even if the flow rate is somewhat small in the vicinity of the trailing edge of the blade. A leakage flow passing through the hub-side clearance is created by the pressure difference between the pressure surface and the suction surface of the blade. Thus, if the clearance on the leading-edge side of the blade (upstream of the center of the chord line of the blade) with the maximum pressure difference is off the mainstream, it is possible to reduce the clearance loss effectively.

As described above, the need for the effect to reduce clearance loss and suppress separation is greater at the leading-edge side of the blade (upstream of the center of the chord line of the blade) and relatively smaller at the trailing-edge side.

Thus, on the trailing-edge side, the disadvantage from a decrease in the efficiency accompanying generation of a recirculation flow may outweigh the advantage of the effect to reduce clearance loss and suppress separation.

In this regard, with the above rotary machine (2), if the above condition (a) is satisfied, the upstream end of the hub-side clearance is retracted from the mainstream of the fluid flow passage at any blade angle. Thus, at the leading-edge side of the blade, it is possible to reduce clearance loss due at a leakage flow that passes through the hub-side clearance and suppress a decrease in separation by forming a recirculation flow.

Furthermore, with the above rotary machine (2), the first blade-facing surface is inclined so as to be away from the rotational center axis of the hub toward downstream, and thereby it is possible to suppress the disadvantage caused by the recirculation flow at the trailing-edge side.

(3) In some embodiments, in the rotary machine described in the above (1) or (2), at least the above condition (b) is satisfied, and the second blade-facing surface is inclined so as to be closer to the rotational center axis of the hub toward downstream.

As described above, the need for the effect to reduce clearance loss and suppress separation is greater at the leading-edge side of the blade (upstream of the center of the chord line of the blade) and relatively smaller at the trailing-edge side. Thus, on the trailing-edge side, the disadvantage from a decrease in the efficiency accompanying generation of a recirculation flow may outweigh the advantage of the effect to reduce clearance loss and suppress separation.

In this regard, with the above rotary machine (3), if the above condition (b) is satisfied, the upstream end of the tip-side clearance is retracted from the mainstream of the fluid flow passage at any blade angle. Thus, at the leading-edge side of the blade, it is possible to reduce clearance loss due to a leakage flow that passes through the tip-side clearance and suppress a decrease in separation by forming a recirculation flow.

Furthermore, with the above rotary machine (3), the second blade-facing surface is inclined so as to be closer to the rotational center axis of the hub toward downstream, and thereby it is possible to suppress the disadvantage caused by the recirculation flow at the trailing-edge side.

(4) In some embodiments, in the rotary machine according to any one of claims (1) to (3), the hub includes a downstream hub portion disposed downstream of the blade-facing hub portion in the axial direction of the hub. The downstream hub portion includes a second outer peripheral surface adjacent to the first blade-facing surface in the axial direction. An expression $Dh2 \leq Dr3$ is satisfied, where $Dh2$ is a distance between a downstream end of the hub-side end surface of the variable blade and the rotational center axis of the hub when the angle formed between the axial direction of the hub and the chord line of the variable blade is minimum, and $Dr3$ is a distance between an upstream end of the second outer peripheral surface and the rotational center axis of the hub.

With the above rotary machine (4), $Dh2 \leq Dr3$ is satisfied, and thereby the hub-side clearance is retracted from the mainstream of the fluid flow passage from the leading-edge side to the trailing-edge side when the blade angle is at its minimum.

As described above in the description on the above rotary machine (2), the need for the effect to reduce clearance loss is greater at the leading-edge side of the blade (upstream of the center of the chord line of the blade) and relatively smaller at the trailing-edge side of the blade. Thus, as with the above rotary machine (4), at the trailing-edge side of the blade, if the hub-side clearance is retracted from the mainstream of the fluid flow passage when the blade angle is minimum, it is possible to satisfy the need for the effect to reduce clearance loss to some extent.

(5) In some embodiments, in the rotary machine described in the above (4), the rotary machine satisfies an expression $Dh3 \leq Dr3$, where $Dh3$ is a distance between a downstream end of the hub-side end surface of the variable blade and the rotational center axis of the hub when the angle formed between the axial direction of the hub and the chord line of the variable blade is maximum, and Dr3 is a distance between an upstream end of the second outer peripheral surface and the rotational center axis of the hub.

With the above rotary machine (5), the entire region of the hub-side clearance is retracted from the mainstream of the fluid flow passage at any blade angle (regardless of the operational state of the rotary machine). Thus, it is possible to enjoy the effect to reduce clearance loss caused by a leakage flow that passes through the hub-side clearance at any blade angle.

(6) In some embodiments, in the rotary machine according to any one of claims (1) to (5), the casing includes a downstream casing portion disposed downstream of the blade-facing casing portion in the axial direction of the hub. The downstream casing portion includes a second inner peripheral surface adjacent to the second blade-facing surface in the axial direction. An expression $Dt2 \geq Dc3$ is satisfied, where Dt2 is a distance between a downstream end of the tip-side end surface of the variable blade and the rotational center axis of the hub when an angle formed between the axial direction of the hub and the chord line of the variable blade is maximum, and Dc3 is a distance between an upstream end of the second inner peripheral surface and the rotational center axis of the hub.

With the above rotary machine (6), $Dt2 \geq Dc3$ is satisfied, and thereby the tip-side clearance is retracted from the mainstream of the fluid flow passage when the blade angle is at its maximum.

As described above in the description on the above rotary machine (2), the need for the effect to reduce clearance loss is greater at the leading-edge side of the blade (upstream of the center of the chord line of the blade) and relatively smaller at the trailing-edge side of the blade. Thus, as with the above rotary machine (6), at the trailing-edge side of the blade, if the tip-side clearance is retracted from the mainstream of the fluid flow passage when the blade angle is maximum (during low-flow-rate operation of the rotary machine), it is possible to satisfy the need for the effect to reduce clearance loss to some extent.

(7) In some embodiments, in the rotary machine described in the above (3), the rotary machine satisfies an expression $Dt3 \geq Dc3$, where Dt3 is a distance between a downstream end of the tip-side end surface of the variable blade and the rotational center axis of the hub when the angle formed between the axial direction of the hub and the chord line of the variable blade is minimum, and Dc3 is a distance between an upstream end of the second inner peripheral surface and the rotational center axis of the hub.

With the above rotary machine (7), the entire region of the tip-side clearance is retracted from the mainstream of the fluid flow passage at any blade angle (regardless of the operational state of the rotary machine). Thus, it is possible to enjoy the effect to reduce clearance loss caused by a leakage flow that passes through the tip-side clearance at any blade angle.

Advantageous Effects

According to at least one embodiment of the present invention, with a rotary machine provided with a variable blade configured to be revolvable about a pivot axis along the radial direction of a hub, it is possible to suppress an increase in clearance loss that accompanies rotation of the variable blade.

BRIEF DESCRIPTION OF DRAWINGS

FIG. 3A is a meridional cross-sectional shape of and around a rotor blade when the blade angle of the rotor blade is at its minimum. FIG. 3B is a meridional cross-sectional shape of and around a rotor blade when the blade angle of the rotor blade is at its maximum.

FIG. 4A is a meridional cross-sectional shape of and around a rotor blade when the blade angle of the rotor blade is at its minimum. FIG. 4B is a meridional cross-sectional shape of and around a rotor blade when the blade angle of the rotor blade is at its maximum.

FIG. 5A is a meridional cross-sectional shape of and around a rotor blade when the blade angle of the rotor blade is at its minimum. FIG. 5B is a meridional cross-sectional shape of and around a rotor blade when the blade angle of the rotor blade is at its maximum.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

On the other hand, an expression such as "comprise", "include", "have", "contain" and "constitute" are not intended to be exclusive of other components.

Figure 1:
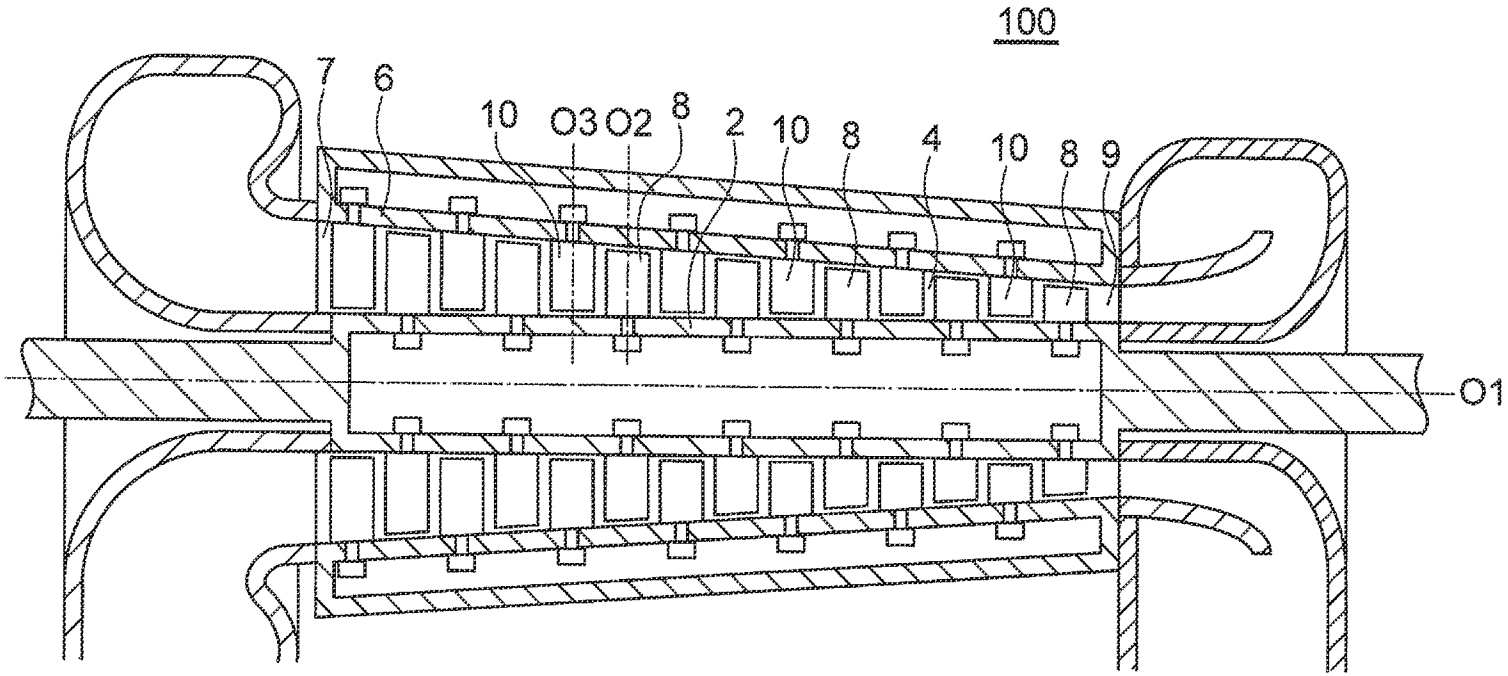
FIG. 1 is a cross-sectional view of a schematic configuration of an axial-flow compressor according to some embodiments.

FIG. 1 is a cross-sectional view of a schematic configuration of an axial-flow compressor 100 serving as a rotary machine according to some embodiments.

The axial-flow compressor 100 shown in FIG. 1 includes a hub 2 configured to rotate about the rotational center axis O1, a casing 6 configured to cover the hub 2 and forming a fluid flow passage 4 with the hub 2, rotor blades 8 fixed to the hub 2, and stationary vanes 10 fixed to the casing 6.

Figure 2:
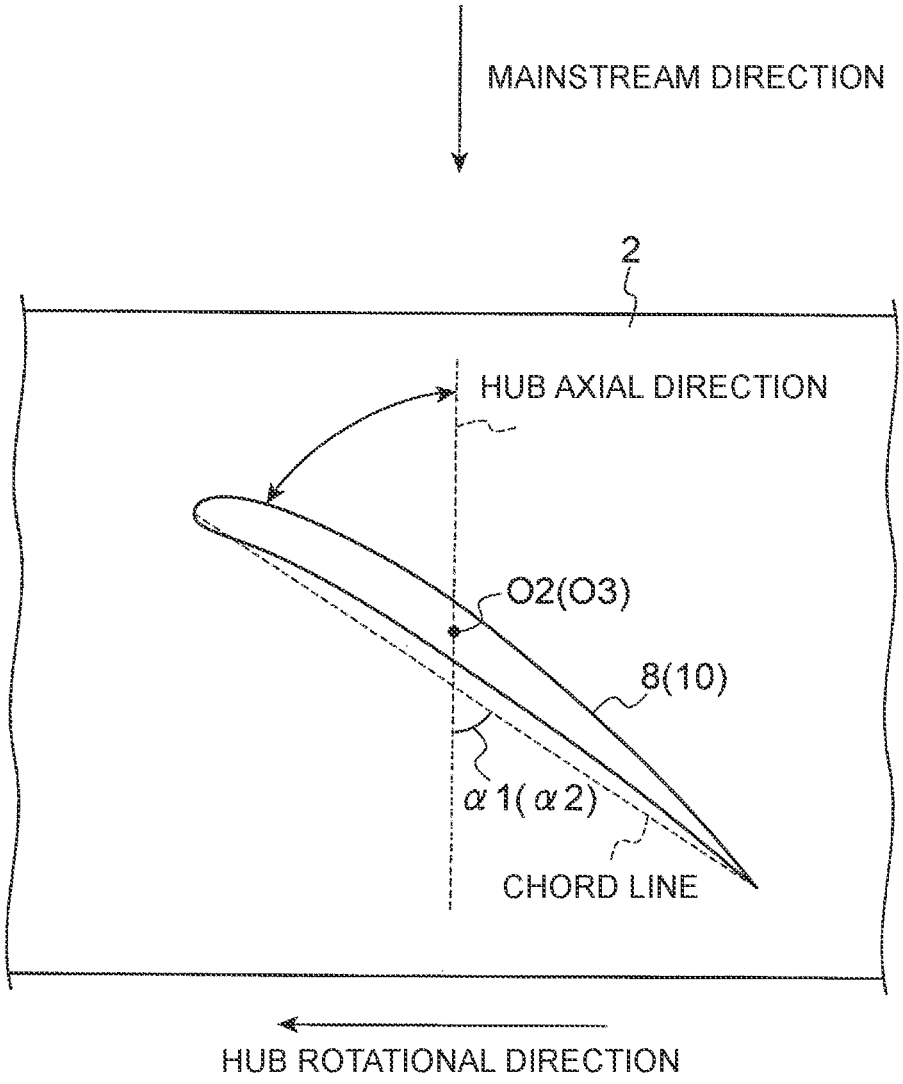
FIG. 2 is a schematic diagram for describing the blade angle $\alpha 1$ of rotor blade and the blade angle $\alpha 2$ of stationary vane, showing a rotor blade or a stationary vane and a part of a hub seen from outside in the radial direction of the hub.

The rotor blades 8 are disposed in the fluid flow passage 4, and configured to be revolvable about the pivot axis O2 along the radial direction of the hub 2, thereby being capable of changing the angle $\alpha 1$ (see FIG. 2; hereinafter, the angle $\alpha 1$ is referred to as the "blade angle" of rotor blade) formed between the axial direction of the hub 2 and the chord line of the rotor blade 8. A plurality of rotor blades 8 are arranged in the circumferential direction at an axial-directional position on the rotational center axis O1, forming one rotor-blade row. A plurality of rotor-blade rows are arranged along the axial direction of the rotational center axis O1 (hereinafter, referred to as the axial direction of the hub 2).

The stationary vanes 10 are disposed in the fluid flow passage 4, and configured to be revolvable about the pivot axis O3 along the radial direction of the hub 2, thereby being capable of changing the angle $\alpha 2$ (see FIG. 2; hereinafter, the angle $\alpha 2$ is referred to as the "blade angle" of stationary vane) formed between the axial direction of the hub 2 and the chord line of the stationary vane 10. A plurality of stationary vanes 10 are arranged in the circumferential direction at a position in the axial direction of the hub 2, forming one stationary-vane row. The rotor-blade rows and the stationary-vane rows are arranged alternately in the axial direction of the hub.

When the hub 2 and the rotor blades 8 fixed to the hub 2 rotate about the rotational center axis O1, a fluid that flows from an inlet 7 of the casing 6 becomes compressed, and the compressed fluid flows out from an outlet 9 of the casing 6.

Next, with regard to the axial-flow compressor 100 shown in FIG. 1, a rotor blade 8 and the meridional cross-sectional shape around the rotor blade 8 according to some embodiments will be described with reference to FIGS. 3 to 5.

Figure 3A:
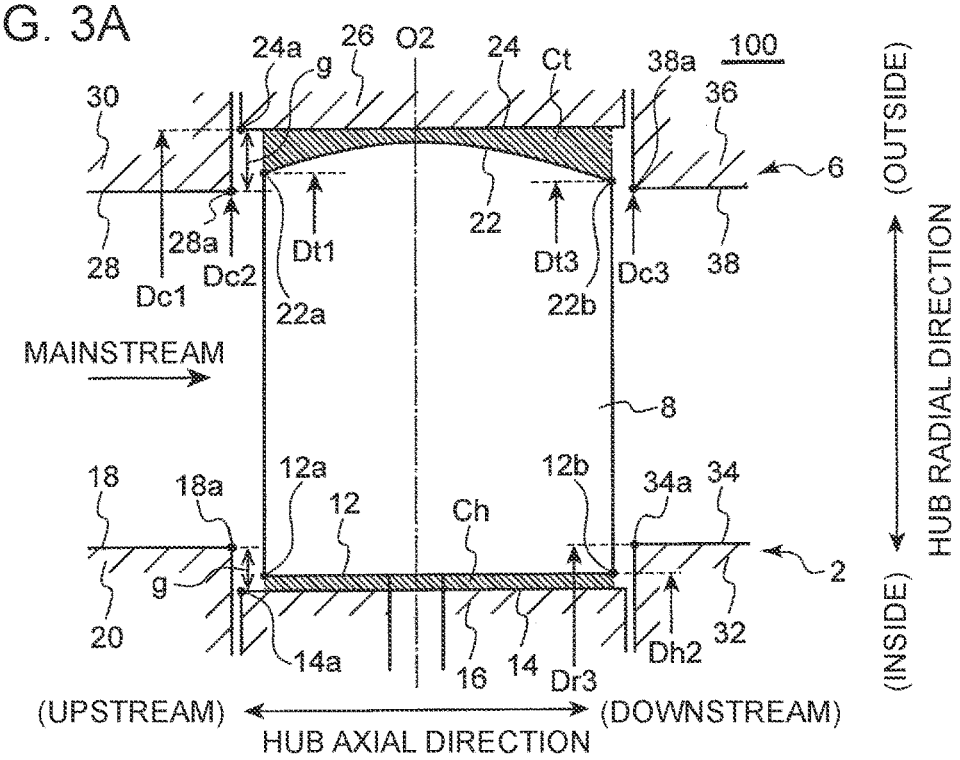
FIGS. 3A and 3B are each a schematic meridional cross-sectional view showing a part of an axial-flow compressor according to an embodiment.
Figure 3B:
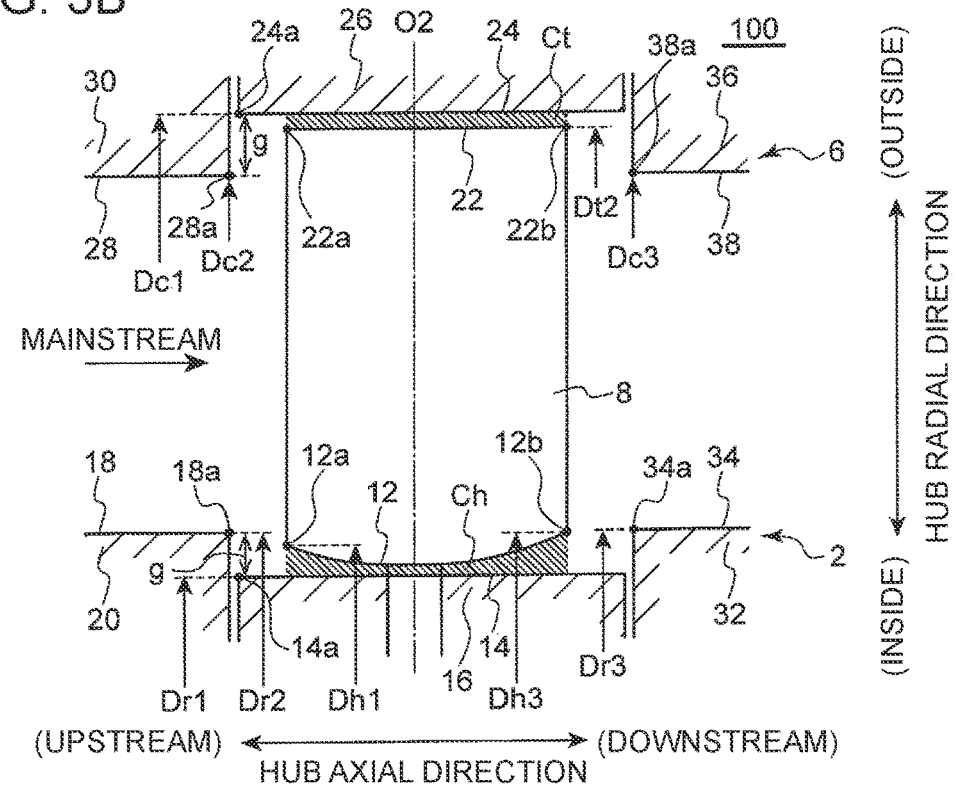
Figure 4A:
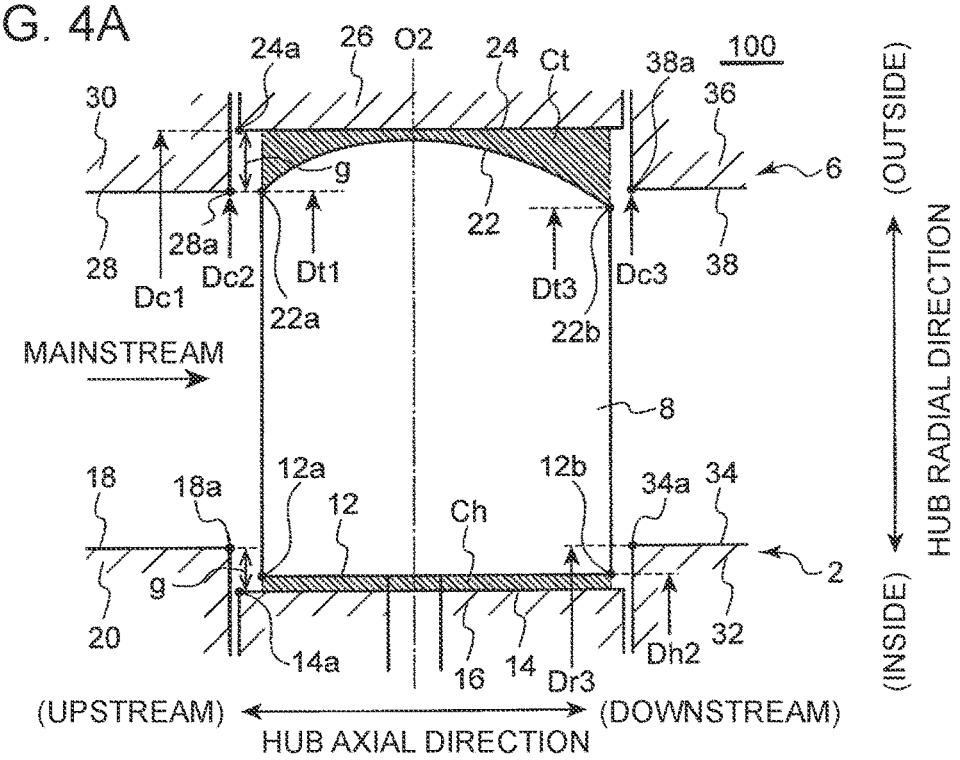
FIGS. 4A and 4B are each a schematic meridional cross-sectional view showing a part of an axial-flow compressor according to an embodiment.
Figure 4B:
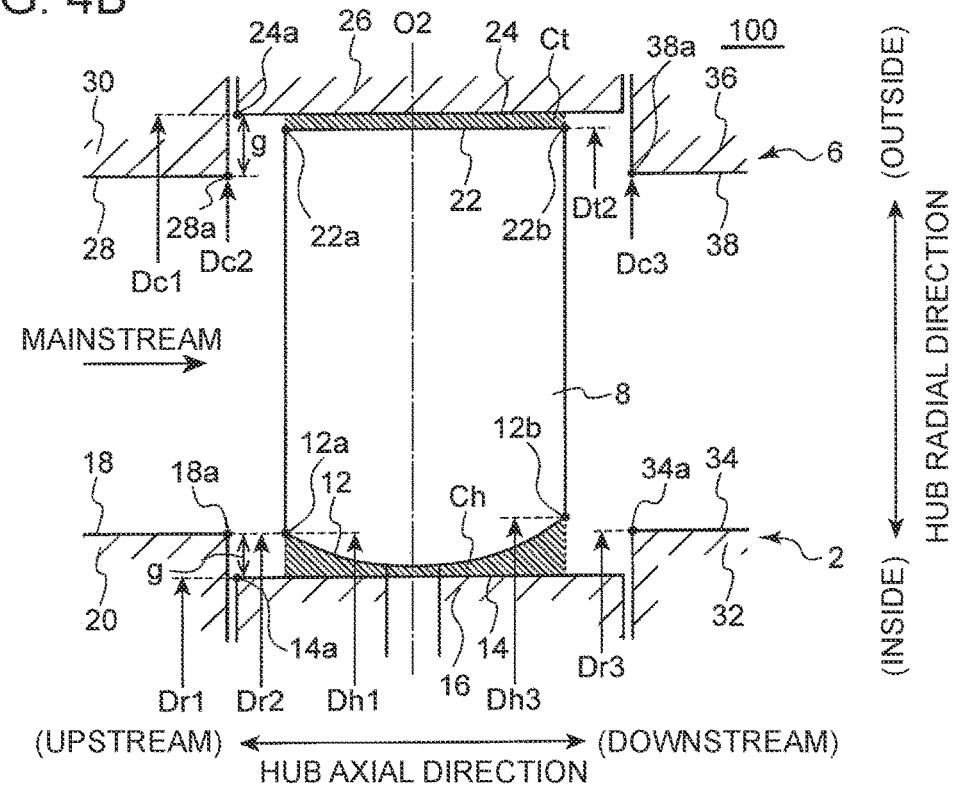
Figure 5A:
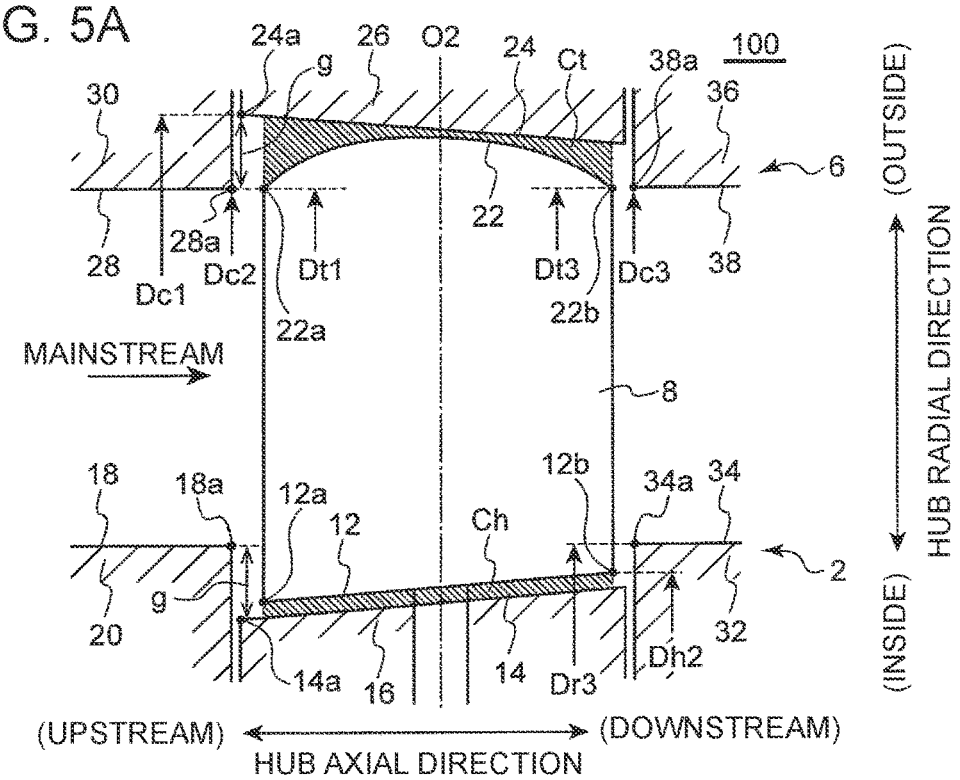
FIGS. 5A and 5B are each a schematic meridional cross-sectional view showing a part of an axial-flow compressor according to an embodiment.
Figure 5B:
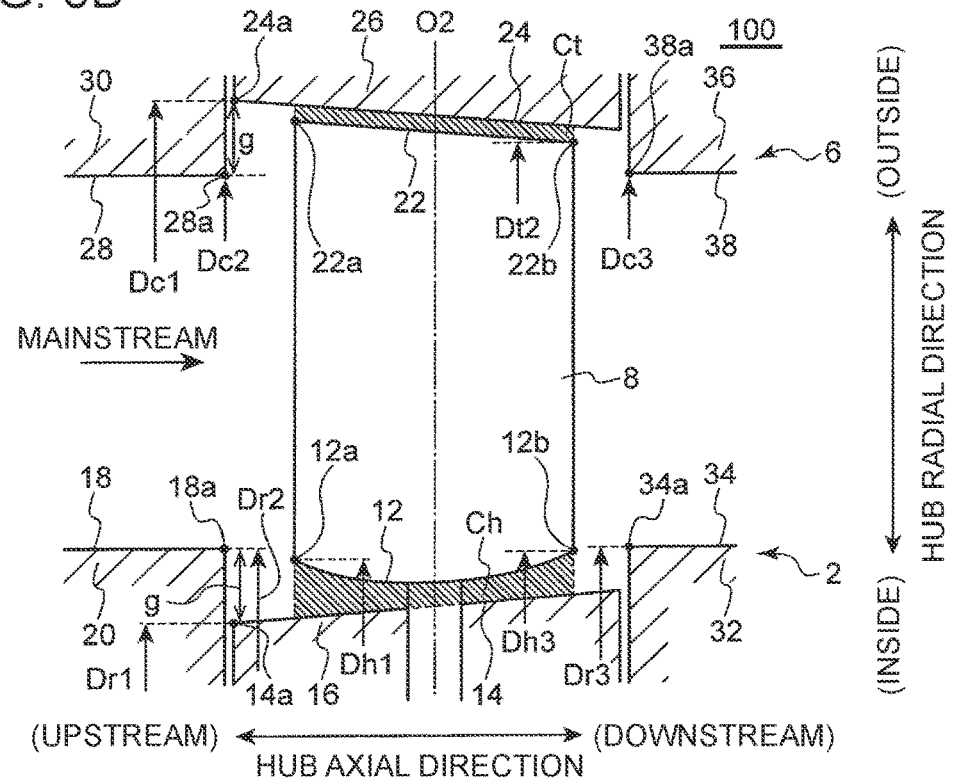

FIGS. 3A and 3B are each a schematic meridional cross-sectional view showing a part of the axial-flow compressor 100 according to an embodiment. FIG. 3A is a meridional cross-sectional shape of and around the rotor blade 8 when the blade angle of the rotor blade 8 is at its minimum. FIG. 3B is a meridional cross-sectional shape of and around the rotor blade 8 when the blade angle of the rotor blade 8 is at its maximum. FIGS. 4A and 4B are each a schematic meridional cross-sectional view showing a part of the axial-flow compressor 100 according to an embodiment. FIG. 4A is a meridional cross-sectional shape of and around the rotor blade 8 when the blade angle of the rotor blade 8 is at its minimum. FIG. 4B is a meridional cross-sectional shape of and around the rotor blade 8 when the blade angle of the rotor blade 8 is at its maximum. FIGS. 5A and 5B are each a schematic meridional cross-sectional view showing a part of the axial-flow compressor 100 according to an embodiment. FIG. 5A is a meridional cross-sectional shape of and around the rotor blade 8 when the blade angle of the rotor blade 8 is at its minimum. FIG. 5B is a meridional cross-sectional shape of and around the rotor blade 8 when the blade angle of the rotor blade 8 is at its maximum.

In some embodiments, as shown in FIGS. 3A to 5B for instance, the hub 2 includes a blade-facing hub portion 16 including the first blade-facing surface 14 facing the hub-side end surface 12 of the rotor blade 8, and an upstream hub portion 20 disposed upstream of the blade-facing hub portion 16 in the axial direction of the hub 2 and including the first outer peripheral surface 18 being adjacent to the first blade-facing surface 14 in the axial direction of the hub 2. Furthermore, as shown in FIGS. 3A to 5B for instance, the casing 6 includes a blade-facing casing portion 26 including the second blade-facing surface 24 facing the tip-side end surface 22 of the rotor blade 8, and an upstream casing portion 30 disposed upstream of the blade-facing casing portion 26 in the axial direction of the hub 2 and including the first inner peripheral surface 28 being adjacent to the second blade-facing surface 24 in the axial direction of the hub 2.

Figure 6:
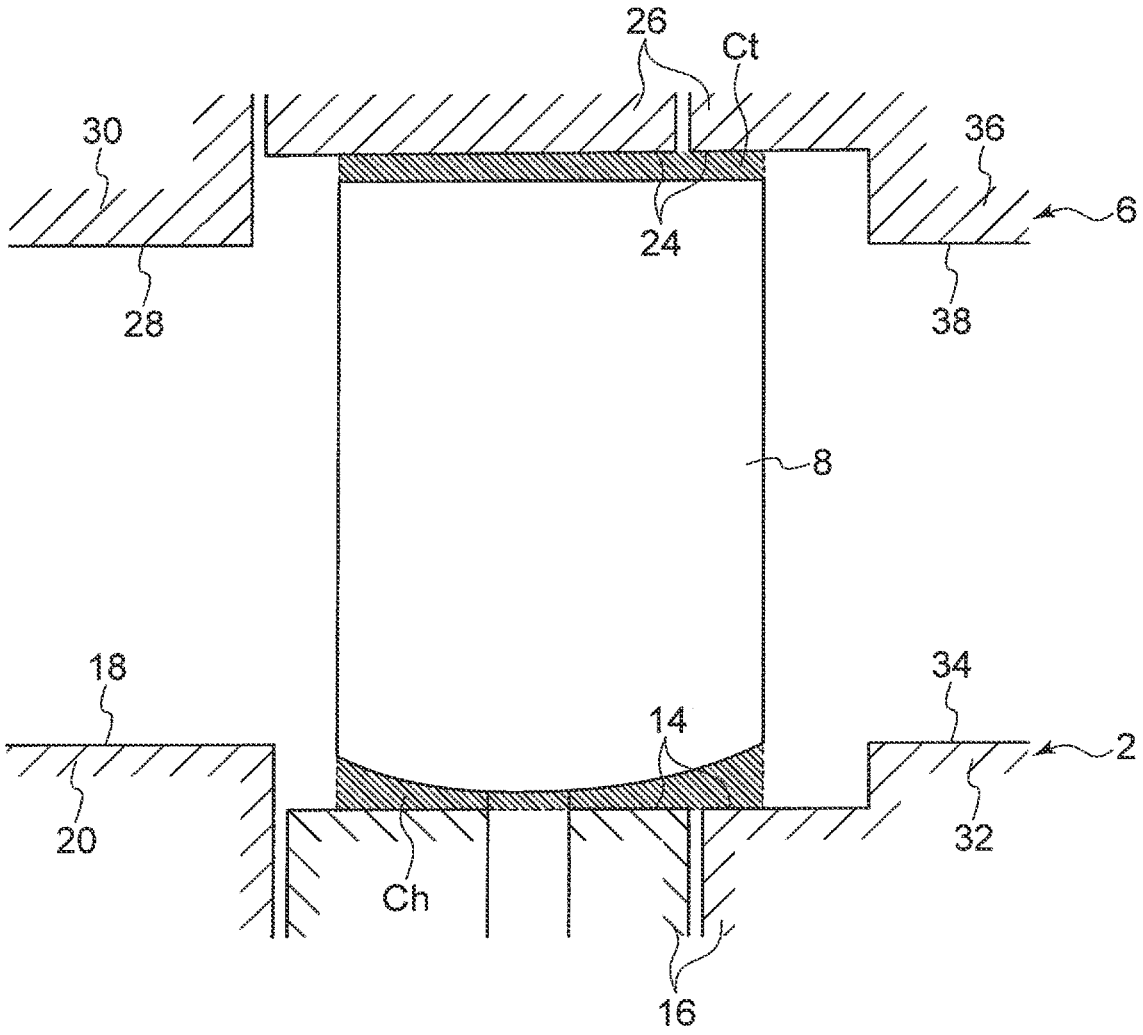
FIG. 6 is a schematic meridional cross-sectional view of a part of an axial-flow compressor according to an embodiment.

Furthermore, the upstream hub portion 20, the blade-facing hub portion 16, and the downstream hub portion 32 may be formed integrally (of one piece), or may be formed separately (of separate members). Alternatively, at least one of the upstream hub portion 20, the blade-facing hub portion 16, or the downstream hub portion 32 may be formed of a plurality of members. For instance, as shown in FIG. 6, the blade-facing hub portion 16 may be formed of a plurality of members.

Furthermore, the upstream casing portion 30, the blade-facing casing portion 26, and the downstream casing portion 36 may be formed integrally (of one piece), or may be formed separately (of separate members). Alternatively, at least one of the upstream casing portion 30, the blade-facing casing portion 26, or the downstream casing portion 36 may be formed of a plurality of members. For instance, as shown in FIG. 6, the blade-facing casing portion 26 may be formed of a plurality of members.

In some embodiments, as shown in FIGS. 3A to 5B for instance, the axial-flow compressor 100 is configured so as to satisfy at least one of the following condition (a) or (b).

$$Dr1 < Dh1 \leq Dr2 \quad \text{(a)}$$

$$Dc1 \geq Dt1 > Dc2 \quad \text{(b)}$$

Herein, as shown in FIGS. 3B, 4B, and 5B, Drl is the distance between the upstream end 14*a* of the first blade-facing surface 14 and the rotational center axis O1 of the hub 2, Dh1 is the distance between the upstream end 12*a* on the hub-side end surface 12 of the rotor blade 8 and the rotational center axis O1 of the hub 2 when the blade angle of the rotor blade 8 is at its maximum, and Dr2 is the distance between the downstream end 18*a* of the first outer peripheral surface 18 and the rotational center axis O1 of the hub 2. Furthermore, as shown in FIGS. 3A, 4A, and 5A, Dc1 is the distance between the upstream end 24*a* of the second blade-facing surface 24 and the rotational center axis O1 of the hub 2, Dt1 is the distance between the upstream end 22*a* of the tip-side end surface 22 of the rotor blade 8 and the rotational center axis O1 of the hub 2 when the blade angle of the rotor blade 8 is at its minimum, and Dc2 is the distance between the downstream end 28*a* of the first inner peripheral surface 28 and the rotational center axis O1 of the hub 2.

Next, the technical advantage of satisfying at least one of the condition (a) or (b) will be described with reference to FIG. 7.

Figure 7:
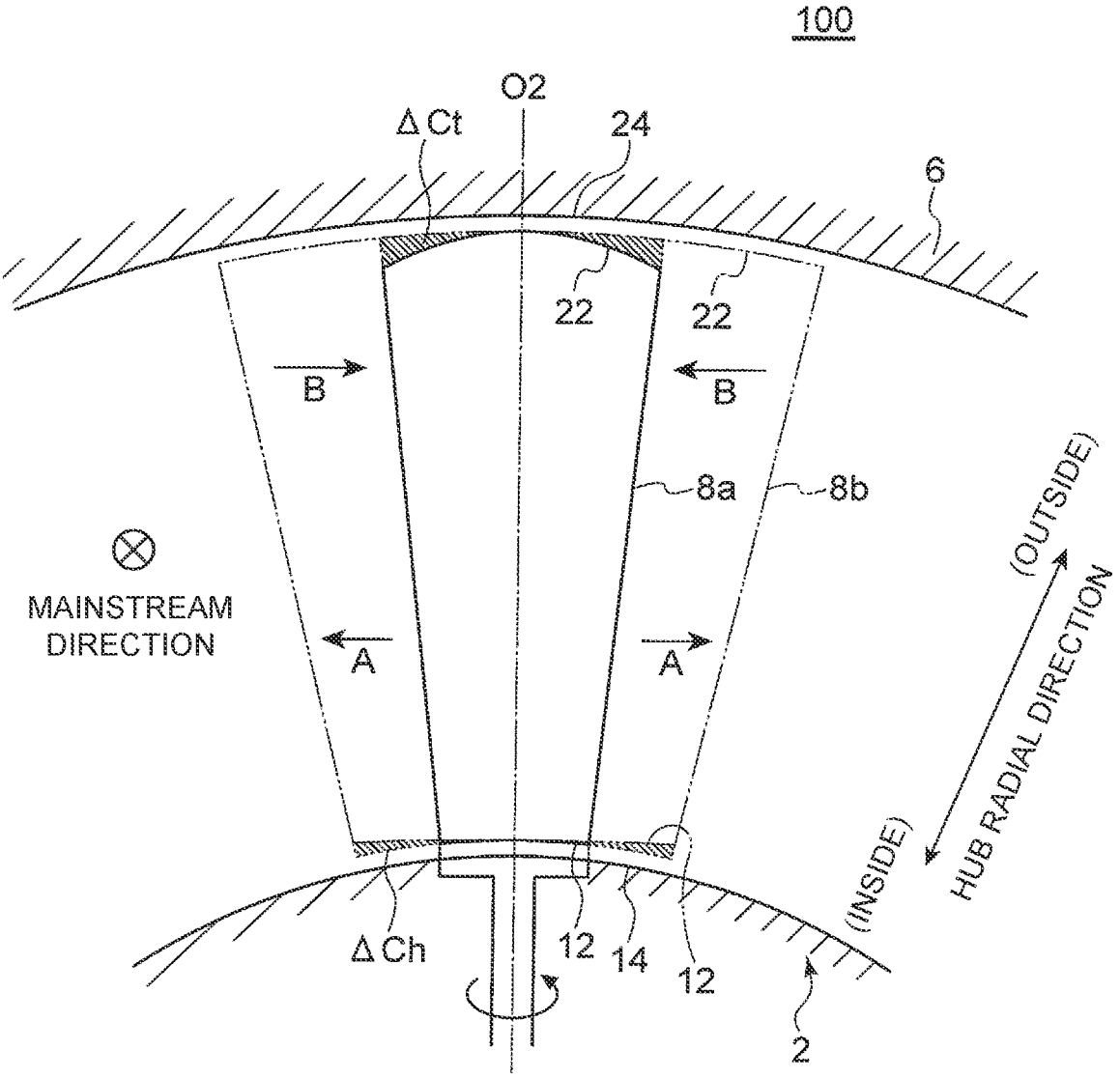
FIG. 7 is a schematic diagram showing the shape (solid line) of the rotor blade as seen from the upstream side along the axial direction of the hub when the blade angle is at its minimum, and the shape (two dotted chain line) of the rotor blade as seen from the upstream side along the axial direction of the hub when the blade angle is at its maximum.

FIG. 7 is a schematic diagram showing the shape 8*a* (solid line) of the rotor blade 8 as seen in the axial direction of the hub 2 when the blade angle is at its minimum, and the shape 8*b* (two dotted chain line) of the rotor blade 8 as seen in the axial direction of the hub 2 when the blade angle is at its maximum.

FIG. 7 shows that the clearance between the hub-side end surface 12 of the rotor blade 8 and the first blade-facing surface 14 of the hub 2 (hereinafter, referred to as merely hub-side clearance) is greater by the region ΔCh when the blade angle of the rotor blade 8 is at its maximum than when the blade angle of the rotor blade 8 is at its minimum. In a case where the hub-side end surface 12 of the rotor blade 8 and the first blade-facing surface 14 of the hub 2 are configured not to interfere with each other in the rotation range of the rotor blade 8, the hub-side clearance increases as the blade 8 is revolved to the close side (direction A in FIG. 7, that is a direction that the blade angle increases). Thus, the hub-side clearance is the maximum when the blade angle of the rotor blade 8 is at its maximum.

FIG. 7 shows that the clearance between the tip-side end surface 22 of the rotor blade 8 and the second blade-facing surface 24 of the casing 6 (hereinafter, referred to as tip-side clearance) is greater by the region ΔCt when the blade angle of the rotor blade 8 is at its minimum than when the angle of the rotor blade 8 is at its maximum. In a case where the tip-side end surface 22 of the rotor blade 8 and the second blade-facing surface 24 of the casing 6 are configured not to interfere with each other in the rotation range of the rotor blade 8, the tip-side clearance increases as the rotor blade 8 is revolved to the open side (direction B of FIG. 7, that is a direction that the blade angle decreases). Thus, the hub-side clearance is the maximum when the blade angle of the rotor blade 8 is at its minimum.

Accordingly, with the axial-flow compressor 100 shown in FIG. 3A to FIG. 5B, if at least one of the above condition (a) or (b) is satisfied, at least one of the hub-side clearance Ch or the tip-side clearance Ct is retracted from the mainstream of the fluid flow passage 4 at the upstream end of the rotor blade 8 at any blade angle. Thus, it is possible to reduce clearance loss due to a leakage flow that passes through at least one of the hub-side clearance Ch or the tip-side clearance Ct.

Figure 8:
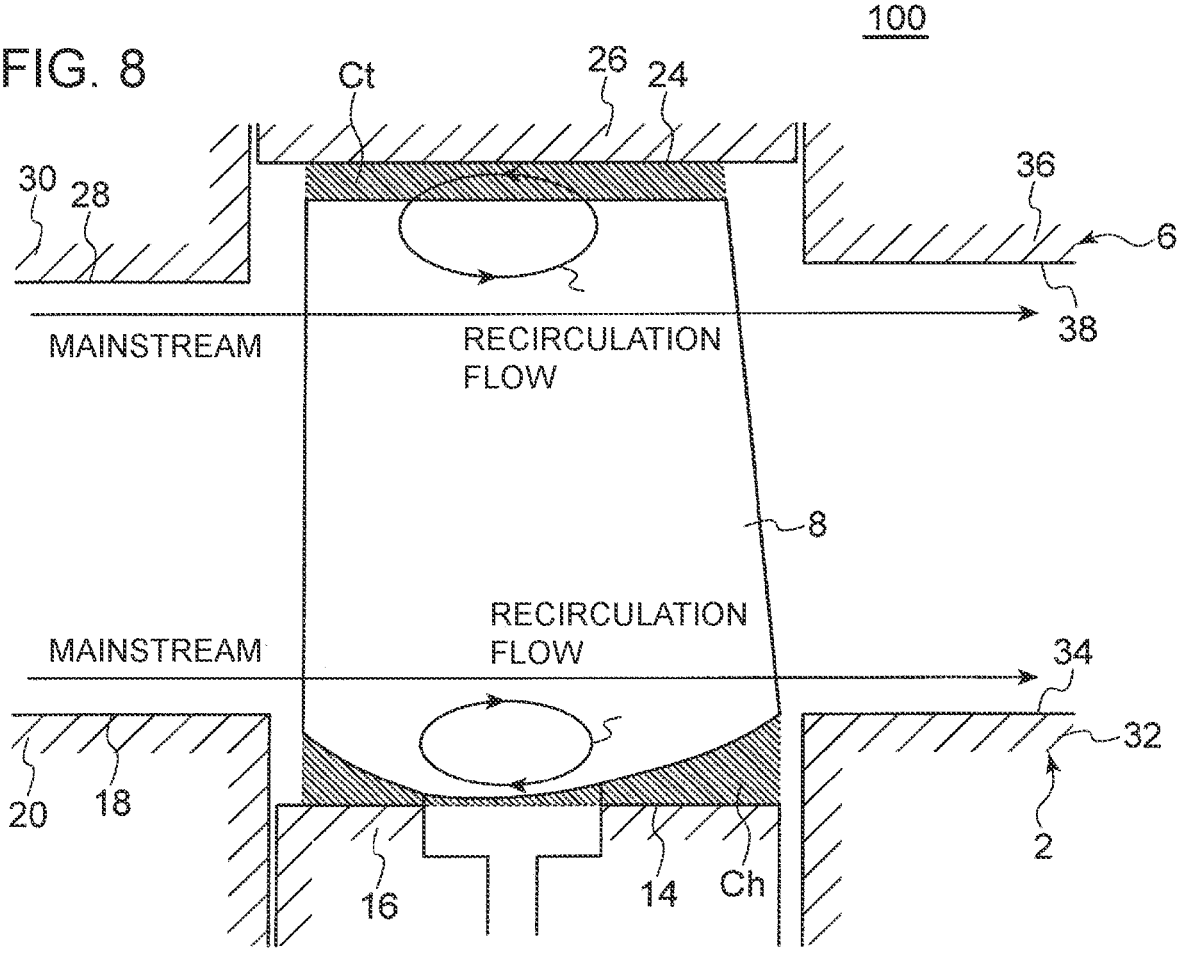
FIG. 8 is a schematic meridional cross-sectional shape for describing a recirculation flow that occurs due to a step between the first outer peripheral surface and the first blade-facing surface or a step between the first inner peripheral surface and the second blade-facing surface.

Furthermore, with the axial-flow compressor 100 shown in FIGS. 3A to 5B, if at least one of $Dr1<Dr2$ (part of condition (a)) or $Dc1>Dc2$ (part of condition (b)) is satisfied, a step g is formed in at least one of the gap between the first outer peripheral surface 18 and the first blade-facing surface 14 or the gap between the first inner peripheral surface 28 and the second blade-facing surface 24. This step g, as shown in FIG. 8, generates a recirculation flow in at least one of the vicinity of the first blade-facing surface 14 of the hub 2 or the vicinity of the second blade-facing surface 24 of the casing 6. This recirculation flow increases the virtual flow rate, and thus it is possible to suppress separation on the hub 2 or the casing 6.

In some embodiments, shown in FIGS. 5A and 5B for instance, the axial-flow compressor 100 satisfies at least the above condition (a), and the first blade-facing surface 14 is inclined so as to be away from the rotational center axis O1 of the hub toward downstream.

Figure 9:
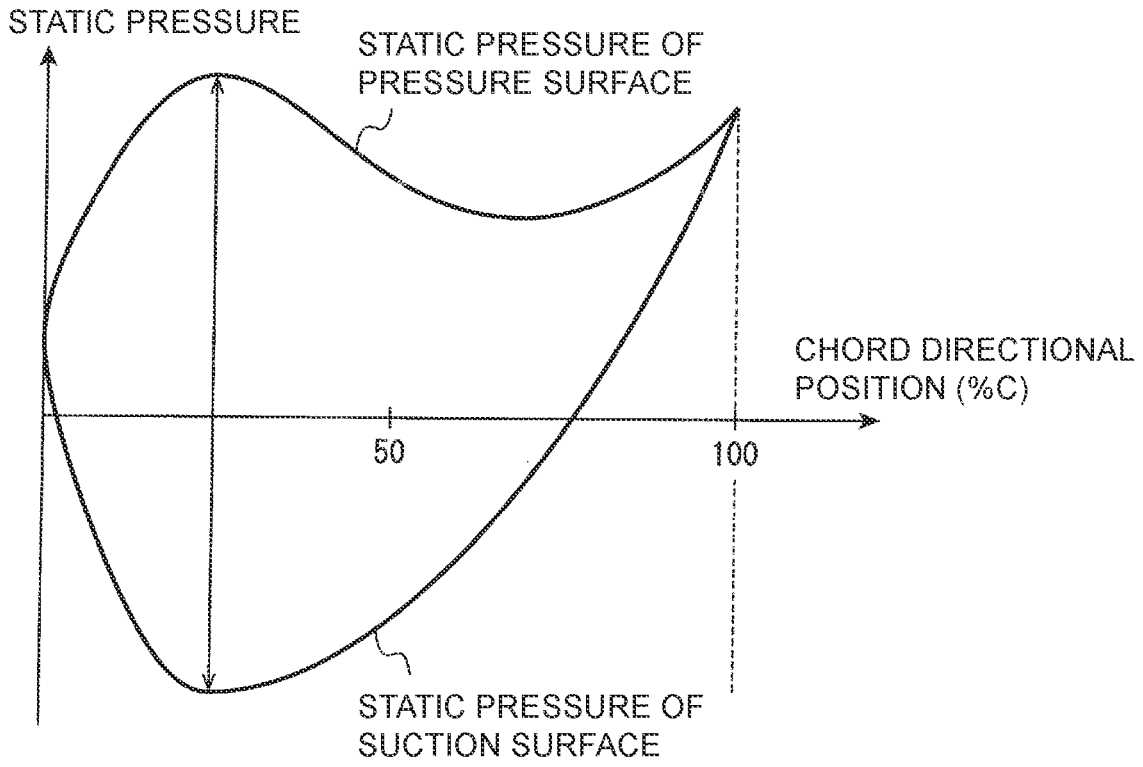
FIG. 9 is a diagram showing a static-pressure distribution with respect to the chord directional position, for the pressure surface and the suction surface of a rotor blade. Herein, the chord directional position is a dimensionless blade-chord length, where 0% represents the leading edge of the rotor blade and 100% represents the trailing edge.

Herein, whether separation occurs tends to depend on the flow rate in the vicinity of the leading edge of the rotor blade 8. If the flow rate in the vicinity of the leading edge of the rotor blade 8 is set to be high, separation can be suppressed easily even if the flow rate is somewhat small in the vicinity of the trailing edge of the rotor blade 8. Further, as shown in FIG. 9, the pressure difference between the pressure surface and the suction surface of the blade tends to be greater at the leading-edge side of the blade (upstream of the center of the chord line of the blade). A leakage flow passing through the hub-side clearance Ch is created by the pressure difference between the pressure surface and the suction surface of the rotor blade 8. Thus, if the clearance on the leading-edge side of the rotor blade 8 with the maximum pressure difference is off the mainstream, it is possible to reduce the clearance loss effectively.

As described above, the need for the effect to reduce clearance loss and suppress separation is greater at the leading-edge side of the rotor blade 8 and relatively smaller at the trailing-edge side. Thus, on the trailing-edge side, the disadvantage from a decrease in the efficiency accompanying generation of a recirculation flow may outweigh the advantage of the effect to reduce clearance loss and suppress separation.

In this regard, with the axial-flow compressor 100 shown in FIG. 5A and FIG. 5B, if the above condition (a) is satisfied, the upstream end of the hub-side clearance Ch is retracted from the mainstream of the fluid flow passage 4 at any blade angle. Thus, at the leading-edge side of the rotor blade 8, it is possible to reduce clearance loss due at a leakage flow that passes through the hub-side clearance Ch and suppress a decrease in separation by forming a recirculation flow. Furthermore, with the axial-flow compressor 100 shown in FIGS. 5A and 5B, the first blade-facing surface 14 is inclined so as to be away from the rotational center axis O1 of the hub 2 toward downstream, and thereby it is possible to suppress the disadvantage caused by the recirculation flow at the trailing-edge side of the rotor blade 8.

In some embodiments, as shown in FIGS. 5A and 5B for instance, the axial-flow compressor 100 satisfies at least the above condition (b), and the second blade-facing surface 24 is inclined so as to be closer to the rotational center axis O1 of the hub 2 toward downstream.

As described above, the need for the effect to reduce clearance loss and suppress separation is greater at the leading-edge side of the rotor blade 8 and relatively smaller at the trailing-edge side. Thus, on the trailing-edge side, the disadvantage from a decrease in the efficiency accompanying generation of a recirculation flow may outweigh the advantage of the effect to reduce clearance loss and suppress separation.

In this regard, with the axial-flow compressor 100 shown in FIG. 5A and FIG. 5B, if the above condition (b) is satisfied, the upstream end of the tip-side clearance Ct is retracted from the mainstream of the fluid flow passage 4 at any blade angle. Thus, at the leading-edge side of the rotor blade 8, it is possible to reduce clearance loss caused by a leakage flow that passes through the tip-side clearance Ct and suppress a decrease in separation by forming a recirculation flow. Furthermore, with the axial-flow compressor 100 shown in FIGS. 5A and 5B, the second blade-facing surface 24 is inclined so as to be closer to the rotational center axis O1 of the hub 2 toward downstream, and thereby it is possible to suppress the disadvantage caused by the recirculation flow at the trailing-edge side.

In some embodiments, as shown in FIGS. 3A, 4A, and 5A for instance, the hub 2 includes a downstream hub portion 32 disposed downstream of the blade-facing hub portion 16 in the axial direction of the hub 2. The downstream hub portion 32 has the second outer peripheral surface 34 adjacent to the first blade-facing surface 14 in the axial direction. The axial-flow compressor 100 is configured to satisfy $Dh2 \leq Dr3$.

Herein, Dh2 is the distance between the downstream end 12*b* of the hub-side end surface 12 of the rotor blade 8 and the rotational center axis O1 of the hub 2 when the blade angle of the rotor blade 8 is at its minimum, and Dr3 is the distance between the upstream end 34*a* of the second outer peripheral surface 34 and the rotational center axis O1 of the hub 2.

With this configuration, Dh2≤Dr3 is satisfied, and thereby the hub-side clearance Ch is retracted from the mainstream of the fluid flow passage 4 from the leading-edge side to the trailing-edge side when the blade angle is at its minimum.

As described above, the need for the effect to reduce clearance loss is greater at the leading-edge side of the rotor blade 8 (upstream of the center of the chord line of the rotor blade 8) and relatively smaller at the trailing-edge side of the rotor blade 8. Thus, as with the axial-flow compressor 100 shown in FIGS. 3A to 5B, at the trailing-edge side of the rotor blade 8, if the hub-side clearance Ch is retracted from the mainstream of the fluid flow passage 4 when the blade angle is minimum, it is possible to satisfy the need for the effect to reduce clearance loss to some extent.

In some embodiments, as shown in FIGS. 3B and 5B for instance, the axial-flow compressor 100 satisfies Dh3≤Dr3.

Herein, Dh3 is the distance between the downstream end 12*b* of the hub-side end surface 12 of the rotor blade 8 and the rotational center axis O1 of the hub 2 when the blade angle is at its maximum, and Dr3 is the distance between the upstream end 34*a* of the second outer peripheral surface 34 and the rotational center axis O1 of the hub 2.

With this configuration, the entire region of the hub-side clearance Ch is retracted from the mainstream of the fluid flow passage 4 at any blade angle. Thus, it is possible to enjoy the effect to reduce clearance loss caused by a leakage flow that passes through the hub-side clearance Ch at any blade angle.

In some embodiments, as shown in FIGS. 3B, 4B, and 5B for instance, the casing 6 includes a downstream casing portion 36 disposed downstream of the blade-facing casing portion 26 in the axial direction of the hub 2. The downstream casing portion 36 has the second inner peripheral surface 38 adjacent to the second blade-facing surface 24 in the axial direction. The axial-flow compressor 100 is configured to satisfy Dt2≥Dc3.

Herein, Dt2 is the distance between the downstream end 22*b* on the tip-side end surface 22 of the rotor blade 8 and the rotational center axis O1 of the hub 2 when the blade angle is at its maximum, and Dc3 is the distance between the upstream end 38*a* of the second inner peripheral surface 38 and the rotational center axis O1 of the hub 2.

With this configuration, Dt2≥Dc3 is satisfied, and thereby the tip-side clearance Ct is retracted from the mainstream of the fluid flow passage 4 when the blade angle is at its maximum.

As described above, the need for the effect to reduce clearance loss is greater at the leading-edge side of the rotor blade 8 and relatively smaller at the trailing-edge side of the rotor blade 8. Thus, as with the axial-flow compressor 100 shown in FIGS. 3B, 4B and 5B, at the trailing-edge side of the rotor blade 8, if the tip-side clearance Ct is retracted from the mainstream of the fluid flow passage 4 when the blade angle is maximum, it is possible to satisfy the need for the effect to reduce clearance loss to some extent.

In some embodiments, as shown in FIGS. 3A and 5A for instance, the axial-flow compressor 100 satisfies Dt3≥Dc3.

Herein, Dt3 is the distance between the downstream end 22*b* of the tip-side end surface 22 of the rotor blade 8 and the rotational center axis O1 of the hub 2 when the blade angle is at its minimum, and Dc3 is the distance between the upstream end 38*a* of the second inner peripheral surface 38 and the rotational center axis O1 of the hub 2.

With this configuration, the entire region of the tip-side clearance Ct is retracted from the mainstream of the fluid flow passage 4 at any blade angle. Thus, it is possible to enjoy the effect to reduce clearance loss caused by a leakage flow that passes through the tip-side clearance Ch at any blade angle.

In some embodiments, the axial-flow compressor 100 may satisfy Dt3<Dc3 as shown in FIG. 4A for instance, or may satisfy Dh3>Dr3 as shown in FIG. 4B for instance. As described above, the need for the effect to reduce clearance loss is relatively small at the trailing-edge side of the rotor blade 8, and thus even with this configuration, satisfying at least one of the above condition (a) or (b) makes it possible to enjoy the effect to reduce clearance loss caused by a leakage flow that passes through the tip-side clearance Ct.

Embodiments of the present invention were described in detail above, but the present invention is not limited thereto, and various amendments and modifications may be implemented.

For instance, while the relationship between the shape of the rotor blade 8 and the shape of the hub 2 or the casing 6 is described in the above embodiments, this relationship can be applied to the relationship between the shape of the stationary vane 10 and the shape of the hub 2 or the casing 6.

Furthermore, to suppress an increase in the hub-side clearance or the tip-side clearance when changing the blade angle, spherical machining as described in Patent Document 1 may be applied to the hub-side end surface 12, the first blade-facing surface 14, the tip-side end surface 22, and the second blade-facing surface 24 if needed.

Furthermore, the present invention can be applied to a rotary machine such as a boiler axial-flow fan, a blast-furnace axial-flow blower, a gas turbine compressor, and various turbines.

DESCRIPTION OF REFERENCE NUMERALS

2 Hub
4 Fluid flow passage
6 Casing
7 Inlet
8 Rotor blade
9 Outlet
10 Stationary vane
12 Hub-side end surface
12*a* Upstream end of hub-side end surface
12*b* Downstream end of hug-side end surface
14 First blade-facing surface
14*a* Upstream end of first blade-facing surface
16 Blade-facing hub portion
18 First outer peripheral surface
18*a* Downstream end of first outer peripheral surface
20 Upstream hub portion
22 Tip-side end surface
22*a* Upstream end of tip-side end surface
22*b* Downstream end of tip-side end surface
24 Second blade-facing surface
24*a* Upstream end of second blade facing surface
26 Blade-facing casing portion
28 first inner peripheral surface
28*a* Downstream end of inner peripheral surface
30 Upstream casing portion
32 Downstream hub portion

34 Second outer peripheral surface
34*a* Upstream end of second outer peripheral surface
36 Downstream casing portion
38 Second inner peripheral surface
38*a* Upstream end of second inner peripheral surface
100 Axial-flow compressor

The invention claimed is:

1. A rotary machine comprising:

a hub configured to be rotatable about a rotational center axis;

a casing configured to cover the hub and forming a fluid flow passage between the casing and the hub; and a variable blade disposed in the fluid flow passage and configured to be revolvable about a pivot axis along a radial direction of the hub, wherein the hub includes:

a blade-facing hub portion including a first blade-facing surface facing a hub-side end surface of the variable blade; and an upstream hub portion disposed upstream of the blade-facing hub portion in an axial direction of the hub and having a first outer peripheral surface being adjacent to the first blade-facing surface in the axial direction, wherein the casing includes:

a blade-facing casing portion including a second blade-facing surface which faces a tip-side end surface of the variable blade; and an upstream casing portion disposed upstream of the blade-facing casing portion in the axial direction and having a first inner peripheral surface being adjacent to the second blade-facing surface in the axial direction, wherein at least one of following condition (a) or (b) is satisfied:

$$Dr1<Dh1\leq Dr2 \quad (a)$$

$$Dc1\geq Dt1>Dc2 \quad (b)$$

where Dr1 is a distance between an upstream end of the first blade-facing surface and the rotational center axis of the hub, Dh1 is a distance between an upstream end of the hub-side end surface of the variable blade and the rotational center axis of the hub when an angle formed between the axial direction of the hub and a chord line of the variable blade is maximum, Dr2 is a distance between a downstream end of the first outer peripheral surface and the rotational center axis of the hub, Dc1 is a distance between an upstream end of the second blade-facing surface and the rotational center axis of the hub, Dt1 is a distance between an upstream end of the tip-side end surface of the variable blade and the rotational center axis of the hub when the angle formed between the axial direction of the hub and the chord line of the variable blade is minimum, and Dc2 is a distance between a downstream end of the first inner peripheral surface and the rotational center axis of the hub, and wherein when condition (a) is satisfied, a distance between Dh1 and Dr1 increases when the angle formed between the axial direction of the hub and the chord line of the variable blade is maximum; and when condition (b) is satisfied, a distance between Dt1 and Dc1 decreases when the angle formed between the axial direction of the hub and the chord line of the variable blade is maximum.

2. The rotary machine according to claim 1, wherein at least the above condition (a) is satisfied, and wherein the first blade-facing surface is inclined so as to be away from the rotational center axis of the hub toward downstream.

3. The rotary machine according to claim 1, wherein at least the above condition (b) is satisfied, and wherein the second blade-facing surface is inclined so as to be closer to the rotational center axis of the hub toward downstream.

4. The rotary machine according to claim 1, wherein the hub includes a downstream hub portion disposed downstream of the blade-facing hub portion in the axial direction of the hub, wherein the downstream hub portion includes a second outer peripheral surface adjacent to the first blade-facing surface in the axial direction, and wherein an expression $Dh2\leq Dr3$ is satisfied, where Dh2 is a distance between a downstream end of the hub-side end surface of the variable blade and the rotational center axis of the hub when the angle formed between the axial direction of the hub and the chord line of the variable blade is minimum, and Dr3 is a distance between an upstream end of the second outer peripheral surface and the rotational center axis of the hub.

5. The rotary machine according to claim 2, wherein the hub includes a downstream hub portion disposed downstream of the blade-facing hub portion in the axial direction of the hub, wherein the downstream hub portion includes a second outer peripheral surface adjacent to the first blade-facing surface in the axial direction, and wherein an expression $Dh3\leq Dr3$ is satisfied, where Dh3 is a distance between a downstream end of the hub-side end surface of the variable blade and the rotational center axis of the hub when the angle formed between the axial direction of the hub and the chord line of the variable blade is maximum, and Dr3 is a distance between an upstream end of the second outer peripheral surface and the rotational center axis of the hub.

6. The rotary machine according to claim 1, wherein the casing includes a downstream casing portion disposed downstream of the blade-facing casing portion in the axial direction of the hub, wherein the downstream casing portion includes a second inner peripheral surface adjacent to the second blade-facing surface in the axial direction, and wherein an expression $Dt2\geq Dc3$ is satisfied, where Dt2 is a distance between a downstream end of the tip-side end surface of the variable blade and the rotational center axis of the hub when an angle formed between the axial direction of the hub and the chord line of the variable blade is maximum, and Dc3 is a distance between an upstream end of the second inner peripheral surface and the rotational center axis of the hub.

7. The rotary machine according to claim 3, wherein the casing includes a downstream casing portion disposed downstream of the blade-facing casing portion in the axial direction of the hub, wherein the downstream casing portion includes a second inner peripheral surface adjacent to the second blade-facing surface in the axial direction, and wherein an expression $Dt3\geq Dc3$ is satisfied, where Dt3 is a distance between a downstream end of the tip-side end surface of the variable blade and the rotational center axis of the hub when the angle formed between the axial direction of the hub and the chord line of the variable blade is minimum, and Dc3 is a distance between an upstream end of the second inner peripheral surface and the rotational center axis of the hub.

8. The rotary machine according to claim 1, wherein a groove generated by gap between the tip-side end surface of the variable blade and the second blade-facing surface is deepened and a groove generated by second gap between the hub-side end surface and the first blade-facing surface is flattened as the angle formed between the axial direction of the hub and the chord line of the variable blade decreases, and the groove generated by the gap between the tip-side end surface and the second-blade facing surface is flattened and the groove generated by second gap between the hub-side end surface and the first blade-facing surface is deepened as the angle formed between the axial direction of the hub and the chord line of the variable blade increases.

* * * * *